US005269080A

United States Patent [19]

Davis

[11] Patent Number: 5,269,080

[45] Date of Patent: Dec. 14, 1993

[54] RETRACTABLE SPIKE SHOE

[76] Inventor: Carl C. Davis, 9150 Appoline, Detroit, Mich. 48228

[21] Appl. No.: 818,576

[22] Filed: Jan. 9, 1992

[51] Int. Cl.[5] ..... A43B 5/00; A43C 15/00

[52] U.S. Cl. ..... 36/134; 36/114; 36/61

[58] Field of Search ..... 36/61, 62, 59 R, 114, 36/134

[56] References Cited

U.S. PATENT DOCUMENTS

| | | | |
|---|---|---|---|
| 3,281,971 | 11/1966 | Weitzner | 36/59 R |
| 3,793,751 | 2/1974 | Gordos | 36/134 |
| 3,983,643 | 10/1976 | Schreyer et al. | 36/61 |
| 4,821,434 | 4/1989 | Chein | 36/134 |
| 4,873,774 | 10/1989 | Lafever | 36/61 |

FOREIGN PATENT DOCUMENTS

| | | | |
|---|---|---|---|
| 83171 | 9/1895 | Fed. Rep. of Germany | 36/61 |
| 191178 | 3/1907 | Fed. Rep. of Germany | 36/61 |

*Primary Examiner*—Steven N. Meyers
*Assistant Examiner*—M.D. Patterson
*Attorney, Agent, or Firm*—Dykema Gossett

[57] ABSTRACT

An athletic shoe has a sole that is slightly, if at all, thicker than soles that are common to athletic shoes. A plurality of spikes or cleats are caused to depend from the bottom of the sole by an actuation mechanism that has a rotatable knob projecting from the back of the athletic shoe. The structure of the sole provides for openings to the undersurface to allow spikes to pivot outwardly beyond the undersurface of the sole. The actuating device has an actuator slide that translates a transverse movement to a pivotal movement of the spikes.

4 Claims, 2 Drawing Sheets

FIG. 1
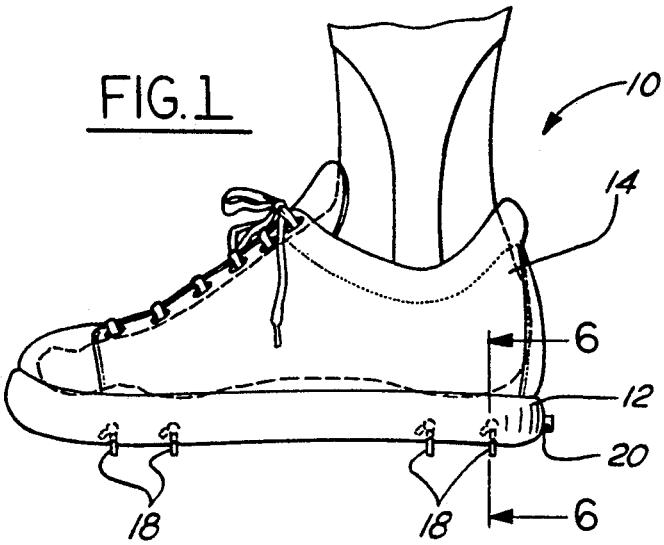
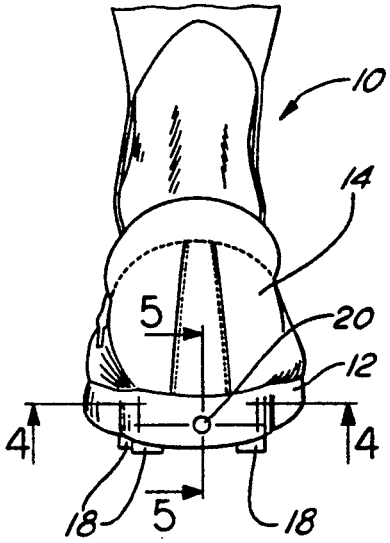
FIG. 2
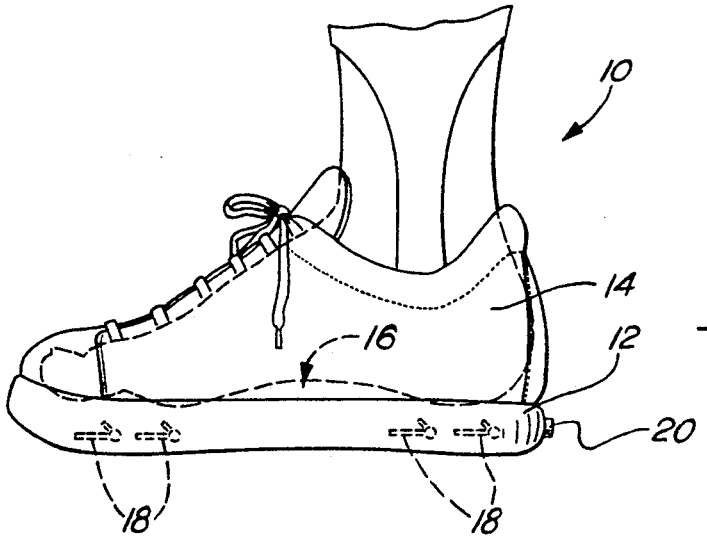
FIG. 3
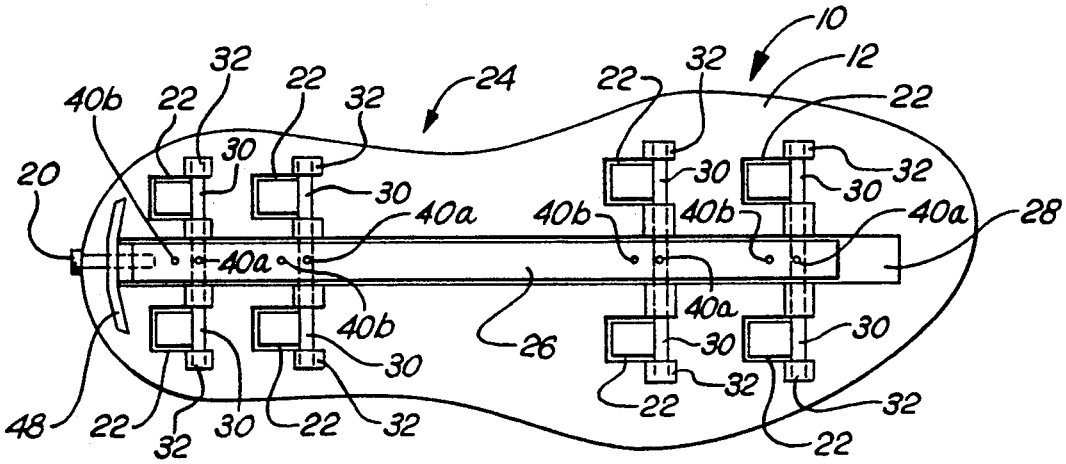
FIG. 4

RETRACTABLE SPIKE SHOE

BACKGROUND OF THE INVENTION

1. Field of the Invention

The present invention relates generally to athletic shoes and, more particularly, to an athletic shoe particularly suited for use in baseball, football, golf, and other sports where cleats or spikes are used for traction on the playing field.

2. Description of the Prior Art

Using the example of baseball shoes, athletic shoes typically comprise a sole having an upper extending upwardly from the sole and into which the foot of the athlete is positioned and secured in place. In addition, a plurality of spikes or cleats are secured to the sole and extend downwardly from it, to improve the traction of the shoe when the athlete runs.

Although the spikes typically found on baseball shoes vary in precise form, usually more than two narrow spikes are secured to the bottom of the sole in a spaced apart relationship near the front or ball portion of the sole. In addition, three or more relatively narrow spikes are secured to the heel of the sole in spaced apart relationship. One example of such a known baseball shoe can be seen in U.S. Pat. No. 3,040,450 which issued on Jun. 26, 1962 to F. C. Phillips. In well known fashion, these previously known spikes dig into the ground when the athlete runs for improved traction.

Such athletic shoes are not adapted for walking on concrete, hardwood flooring, or carpeting. The artificial turf that is used in many stadiums today are a form of carpeting not particularly suitable for athletic shoes with cleats or spikes. Many users of such athletic shoes find themselves at times in a dugout walking on cement. After an athletic event, athletes retire to locker rooms or some other room having flooring not adapted for use of spiked athletic shoes. Athletes find themselves wearing their spiked athletic shoes on adjoining paved areas, in club houses, and in locker rooms without taking off the shoes and subjecting themselves to the risk of slipping and falling with grave consequential injuries. If the flooring is made of wood, the flooring becomes marred and damaged, and if the flooring is carpeted, the carpet life would be severely shortened.

Various types of devices have been developed to provide for athletic shoes and footwear that may be converted so that spiked or protruding elements do not contact flooring.

U.S. Pat. No. 4,873,774 issued to Lafever on Oct. 17, 1989, discloses a shoe sole that has one or more chambers, each housing a piston-like cleat plate fitted for vertical movement in the chamber. Each cleat plate has a cleat mounted on it. When a source of fluid pressure, for example from a squeeze bulb type air pump, is directed in the chamber bounded by the fitted cleat plate, the plate or cleat moves downwardly to cause the cleat to extend from the soles of the shoe.

U.S. Pat. No. 4,825,562 issued to Chuang on May 2, 1989, discloses shoes with two sets of elastic nails in the sole. Like the device invented by Lafever, the nails or "cleats" are in a vertical orientation requiring a relatively thick sole for them to be housed in a retracted position. The thick sole is also used to house a box that includes a switching device and a moving board. The moving board cams the nails outwardly to extend from the sole.

U.S. Pat. No. 4,821,434 issued to Chein on Apr. 18, 1989, discloses a shoe that has spikes which may be extended and retracted by T-shaped rail members. The camming of the spikes to extend or retract is actuated by impacting the front or rear of the shoe sole against a solid target such as a wall or road surface.

U.S. Pat. No. 4,333,249 issued to Schaefer on Jun. 8, 1982, discloses a device that pivots outwardly from a housing that may be the sole of the shoe. The pivoting element is a roller device that is not made for gripping a surface, but shows the technology of retracting an element into a foot housing.

U.S. Pat. No. 3,793,751, issued to Gordos on Feb. 26, 1974, discloses a retractable spike that is used particularly as a golf shoe. The movement of the spikes in this device is accomplished from outside the shoe by rotation of a knob. The rotation of knob again presents the spikes in the vertical orientation that they are in to grip the surface when the shoe is worn.

U.S. Pat. No. 3,243,902, issued to Chapman on Apr. 5, 1966, discloses a golf shoe having a protective sole to be placed over the shoe so that the spikes are not presented to the turf.

U.S. Pat. No. 2,920,404, issued to Ross on Jan. 12, 1960, describes a safety heel for shoes that carries a spike for engaging the ground during slippery or icy conditions.

U.S. Pat. No. 2,076,316, issued to Beals, Jr., on Apr. 6, 1937 shows another device of the protective sole variety as an example of the technology used to protect the spikes against being presented to damage ground surfaces.

The various devices described above, as found in U.S. patents, all disclose means of technology used to isolate spikes from the ground when not being used to grip the ground. The devices, however, either are clumsy in use because of the bulkiness of actuating devices, or the thickness of soles, or the storing of protection or isolation devices worn over the spikes when no contact with flooring is desired and taken off when the spikes are exposed.

SUMMARY OF THE INVENTION

In view of the aforesaid drawbacks of the earlier devices showing retractable or isolated spikes, the present invention is presented. The major feature of the present invention resides in the simple, light, and relatively thin sole structure. The athletic shoe according to the present invention has a sole and an upper is attached to and extending upwardly from the sole. The shoe wearer is to have his or her foot housed in the upper which may be styled as a conventional athletic shoes with cushioned innards, lacing, tongue, and other structure known to those of ordinary skill in the art of athletic shoes.

The sole of the athletic shoe of the invention is of a usual shape and is slightly, if at all, thicker than soles that are common to athletic shoes. It may be of a material of high elasticity such as rubber or the like. A plurality of spikes or cleats are caused to depend from the bottom of the sole by an actuation mechanism that has a rotatable knob projecting from the back of the athletic shoe. The structure of the sole provides for openings to the undersurface to allow spikes to pivot outwardly beyond the undersurface of the sole.

An actuating device, for pivoting the spikes outwardly to depend from the sole, has an actuator slide that translates a transverse movement to a pivotal movement of the spikes. The actuator slide is connected to the knob projecting from the back of the athletic shoe. The actuator slide is recessed in a channel, which is not open to the undersurface of the sole. The channel is longer than the actuator slide, so that the actuator slide may move axially to and fro in the channel, and it is this to and fro movement that is translated into the pivotal movement that causes the spikes to pivot into and out of the openings beneath the sole of the athletic shoe.

A plurality of axles are pivotally mounted in bushings and are aligned parallel to each other along the extension of the actuator slide. Two spikes mount each axle, on to either side of the slide actuator. The spikes pivot as the axle pivots. Also mounted on each axle is a pair of cam following projections. The actuator slide has camming holes aligned to receive cam following projections. As the actuator slide slides to and fro within the channel, one of cam following projections is in one of the camming holes and is cammed into pivoting from the one camming hole as the other cam following projection enters into the other camming hole. The pivoting movement imparted to each axle by the pivoting of cam following projections cause the axle to pivot, which causes the spikes to pivot. Predetermined spaced relationship between the camming hole and cam following projections for each axle with respect to the camming holes and cam following projections for each other axle cause each axle and the spikes to pivot simultaneously together in and out of the openings as the actuator slide slides to and fro within the channel.

The knob projecting from the back of the athletic shoe is integral with a shaft that has a threaded end, which is received through a threaded coupling. The threaded coupling is fixedly connected to the actuator slide. The shaft is mounted in the sole so that it may turn freely about its longitudinal axis as the knob is turned, but is not displaced from its position in the sole. Because of the threaded relationship between the threaded end of the shaft and threaded coupling attached to the actuator slide, as the shaft turns about its axis, the threaded coupling and the actuator slide are translated axially within the channel to impart the to and fro movement of the actuator slide. Thus, turning the knob imparts to and fro movement to the actuator slide, which cams the axles into pivoting the spikes into and out of the openings in the underside of the sole of the athletic shoe.

Another embodiment of the actuating device has a shaft that is connected via a first spring to the actuator slide. A pair of flanges project radially from the spring. The actuator slide is connected to the front end of the athletic shoe by a second spring. This latter spring is stronger than the former spring, but when the knob is pulled, the spring force of latter spring is overcome causing the actuator slide to slide in the direction of the rear of the athletic shoe. A stop wall at the rear of the athletic shoe has a slot which admits the flanges of first spring when they are aligned with the slot to pass through. Without such alignment, the stop wall keeps the first spring from elongating and thereby causes the second spring to stay in its elongated posture. The first spring functions to pull the shaft and knob back when the knob is pulled out from the back of the athletic shoe to pull the spring and its flanges rearwardly beyond the stop wall and then the knob is released. Thus, pulling the knob out from the back of the athletic shoe and twisting the knob pulls the actuator slide to the rear of the channel and holds it there with the spikes retracted by the camming mechanism. Twisting the knob, so that the spring flanges are allowed to pass through the slot in the stop wall, causes the actuator slide to slide to the front end of the channel and causes the spikes to pivot outwardly.

BRIEF DESCRIPTION OF THE DRAWINGS

FIG. 1 illustrates an elevational view of the present invention (in which the spikes are shown in a extended condition).

FIG. 2 illustrates a rear elevational view of the present invention (in which the spikes are shown in a extended condition).

FIG. 3 illustrates an elevational view of the present invention (in which the spikes are shown in a retracted condition).

FIG. 4 is a sectional view of FIG. 2 taken along line 4—4 (showing relative positions of the spikes and one embodiment of the actuator mechanism disposed in the sole of the athletic shoe according to the invention).

DETAILED DESCRIPTION OF THE PREFERRED EMBODIMENT

Figure 5:
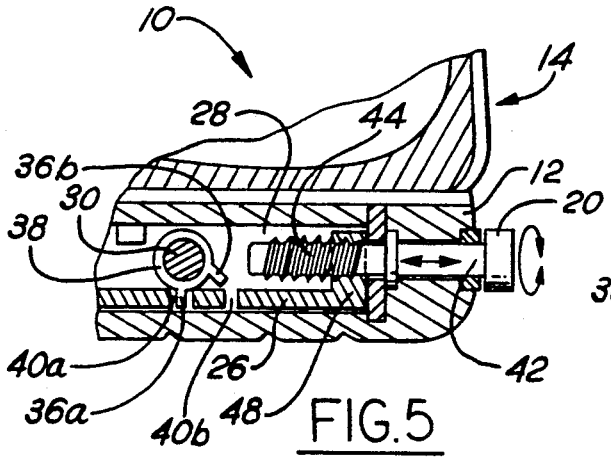
FIG. 5 is a partial sectional view of FIG. 2 taken along line 5—5 (illustrating the embodiment of FIG. 4).

Referring to FIGS. 1 and 2, the athletic shoe according to the present invention is shown generally as athletic shoe 10. Athletic shoe 10 has a sole 12 and an upper 14. Upper 14 is attached to sole 12 and extends upwardly from sole 12. The shoe wearer is to have his or her foot housed in the upper 14 cradled between the upper 14 and sole 12. The upper 14 may be of any styling, including conventional styles traditionally used in athletic activities. As with conventional shoes of this type, upper 14 may have cushioned innards, lacing, tongue, and other structure for an athletic shoe. It may be made of leather or synthetic material, also known to those in the art as conventional with athletic shoes.

Sole 12 is of a usual shape and is slightly, if at all, thicker than soles that are common to athletic shoes used on artificial turf or for shoes known as "cross trainers", which are suitable for a variety of sport activity. Sole 12 includes an inner lining 16 which may be padded for cushioning and provides support for the arch of the foot contained in upper 14. Sole 12 may be of a material of high elasticity such as rubber or the like, which is molded so that sole 12 will have patterned traction projections and depressions to provide the best elasticity and durability to resist impact and provide traction against slipping. Such patterns may conform to patterns designed for durability and traction with the knowledge of person of ordinary skill in the athletic shoe art.

Referring now to FIG. 1 only, there is shown a plurality of cleats or spikes 18 projecting from the bottom of sole 12. An actuation mechanism is evinced by a rotatable knob 20 which functions in a manner to be explained later. Rotatable knob 20 projects from the back of athletic shoe 10 at sole 12 proximate to upper 14.

Referring now to FIG. 3, all of the components seen in FIG. 1 are shown except for spikes 18. It is to be appreciated that spikes 18 are recessed within sole 12 in accordance with another aspect of the invention, differing from the aspect shown in FIG. 1.

Now referring to FIG. 4, the a section through the sole 12 of shoe 10 is shown. Those of ordinary skill in the art would know of the advantageous use of recesses and projections comprising the typography of the undersurface of sole 12, which is not shown but is known to those of ordinary skill in the art. The recesses and projections provide traction and durability. These elements, as incorporated into the present invention, are not referred to as novel elements. Of more significance, is the structure of sole 20 in providing openings 22 to the undersurface to allow spikes 18 to pivot outwardly beyond the undersurface of sole 12.

Figure 6:
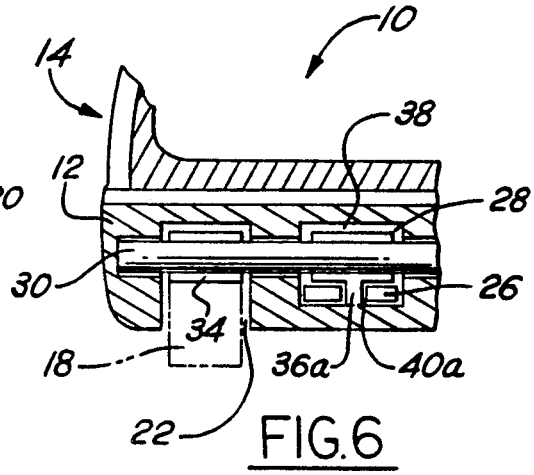
FIG. 6 is a partial sectional view of FIG. 1 taken along line 6—6 (illustrating the embodiment of FIG. 4).
Figure 7:
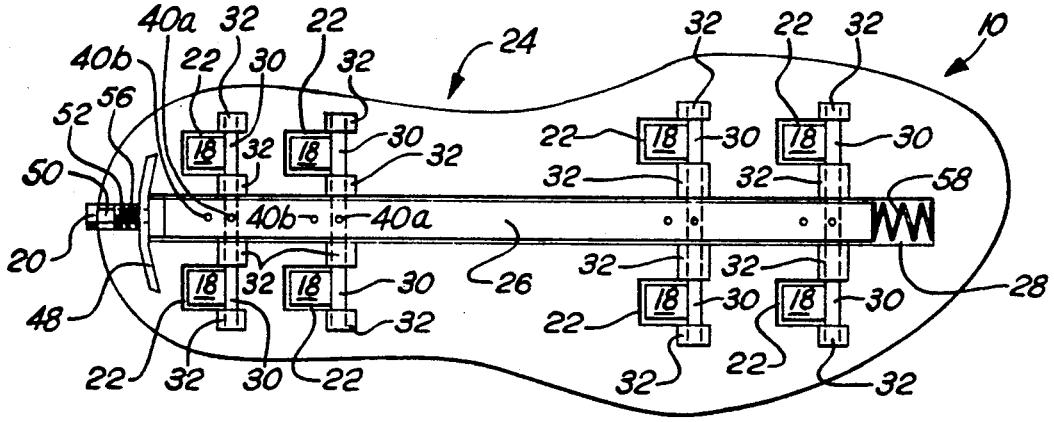
FIG. 7 is a sectional view of FIG. 2 taken along line 4—4 (showing relative positions of the spikes and a second embodiment of the actuator mechanism disposed in the sole of the athletic shoe according to the invention).

Still referring to FIG. 4, but with reference also to FIGS. 6 and 7, there is shown an actuator generally at 24, which includes an actuator slide 26. Actuator 24 translates a transverse movement to a pivotal movement of spikes 18. Actuator slide 26 is connected, by means that will be explained later, to knob 20. It is preferable that actuator slide 26 is a plastic elongated member that would not be vulnerable to rust and corrosion.

Actuator slide 26 is recessed in a closed channel 28. The channel 28 is characterized as "closed" to mean that channel 28 is not open to the undersurface of sole 12, although channel 28 is open along its length to house actuator slide 26. Channel 28 is longer than actuator slide 26, so that actuator slide 26 may move axially to and fro in channel 28. It is this to and fro movement that is translated into the pivotal movement that causes spikes 18 to pivot into and out of openings 22.

As shown in the preferred embodiment of FIG. 4, a plurality of axles 30 are pivotally mounted in bushings 32, which are some of a number of recessed parts in sole 12 to secure components of actuator 24 and spikes 18 to sole 12. Axles 30 are aligned parallel to each other along the extension of actuator slide 26 which parallels the longitudinal extension of shoe 10. Mounted on each axle 30 on each side of actuator slide 10, in balancing relationship with each other, is a spike 18. Accordingly, two spikes 18 mount each axle. Each spike 18 may be integrally fixed to a bushing 34 (as shown in FIG. 6) which is fixed mounted on axle 30, or each spike may be fixed integrally to axle 30. In either case, the spikes 18 pivot as the axle 30 pivots.

Also mounted on each axle 30 is a pair of cam following projections **36*a* and 36*b*. Cam following projections 36*a* and 36*b* may also be integrally fixed on a bushing 38 mounted fixedly to axle 30 or they may be integrally fixed on axle 30. In the preferred embodiment, the cam following projections 36*a* and 36*b* mounted on each axle 30 project at a 45 degree angle of one another. One projection 36*a* projects generally at an angle of 90 degrees from spikes 18 on an axle 30, so that, when spikes 18 are recessed in opening 22, cam following projection 36*a* projects perpendicularly to and downwardly toward the undersurface of sole 12 of shoe 10. Actuator slide 26 has camming holes 40*a* and 40*b* aligned to receive respective cam following projections 36*a* and 36*b*. As actuator slide 26 slides to and fro within channel 28, one of cam following projections 36*a* and 36*b* is in one of camming holes 40*a* and 40*b* and is cammed into pivoting from camming holes 40*a* and 40*b* as the other of cam following projections 36*a* and 36*b* enters into the other of camming holes 40*a* and 40*b*. The pivoting movement imparted to the axle by the pivoting of cam following projections 36*a* and 36*b* cause axle 30 to pivot, which causes spikes 18 to pivot. Predetermined spaced relationship between camming holes 40*a* and 40*b* and cam following projections 36*a* and 36*b* for each axle 30 with respect to canning holes 40*a* and 40*b* and cam following projections 36*a* and 36*b* for each other axle 30 cause each axle 30 and spikes 18 to pivot simultaneously together in and out of openings 22 as actuator slide 26 slides to and fro within channel 28**.

Referring to FIG. 5 in particular, it can be seen that knob 20 is integrally and fixedly connected to a shaft 42. Shaft 42 has a threaded end 44 which is received through a threaded coupling 46. Threaded coupling is fixedly, preferably integrally, connected to actuator slide 26. Shaft 42 is mounted in sole 12 so that it may turn freely about its longitudinal axis as knob 20 is turned, but is not displaced from its position in sole 12. Because of the threaded relationship between the threaded end 44 of shaft 42 and threaded coupling 46 attached to actuator slide 26, as shaft 42 turns about its axis, threaded coupling and actuator slide 26 are translated axially within channel 28 to impart to and fro movement of actuator slide 26. Travel is limited by the length of channel 28, by a stop wall 48 embedded in sole 12 and having an opening for shaft 42 to pass through, and by the limitation on pivoting because of cam following projections **36*a* and 36*b* contacting upper wall of channel 28, or by a combination of these elements. Thus, turning knob 20 imparts to and fro movement to actuator slide 26, which cams axles 30 into pivoting spikes 18 into and out of openings 22**.

Figure 8:
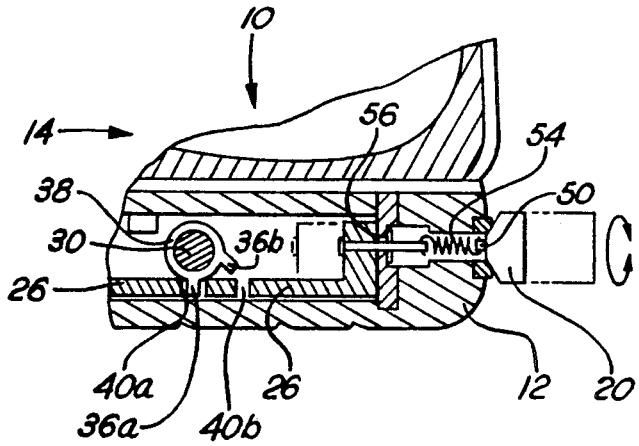
FIG. 8 is a partial sectional view of FIG. 2 taken along line 5—5 (illustrating the embodiment of FIG. 7).

As can be seen in FIGS. 7 and 8, another embodiment of the actuator 24 is shown. In this embodiment, shaft 50 is fixedly and, again, preferably integrally connected to knob 20. Shaft 50 is axially slidably mounted in bushing 52. At the end of shaft 50 that is remote from knob 20, a spring 54 connects shaft 50 to actuator slide 26. A pair of flanges 56 project radially from spring 54. Actuator slide 26 is connected to the front end of shoe 10 and of sole 12 by a spring 58. Spring 58 is stronger than spring 54, but when knob 20 is pulled, the spring force of spring 58 is overcome causing actuator slide 26 to slide in the direction of the rear of shoe 10. Stop wall 48 has a slot which admits the flanges 54 of spring 54 when they are aligned with the slot to pass through. Without such alignment, stop wall 48 keeps spring 48 from elongating and thereby causes spring 58 to stay in its elongated posture. Spring 54, however, pulls shaft 50 back within bushing 52 when knob 20 is released. Thus, pulling knob 20 out from the back of shoe 10 and twisting the knob pulls actuator slide 26 to the rear of channel 28 and holds it there with the spikes 18 retracted by the camming mechanism explained above for the embodiment shown in FIGS. 4–7. Twisting knob 20 so that flanges 56 are allowed to pass through the slot in stop wall 48, causes actuator slide 26 to slide to the front end of channel 28 and causes spikes 18 to pivot outwardly.

The aforesaid embodiments are used for describing the objects, the features and the functions of the present invention. Any change or modification of the present invention made by any person skilled in the art should not be deemed having deviated from the spirit or scope of this invention if the modifications are but the equivalent of the invention as defined with the claims attached hereto. Slide 26 is translated axially within channel 28 to impart to and fro movement of actuator slide 26. Travel is limited by the length of channel 28, by a stop wall 48 embedded in sole 12 and having an opening for shaft 42 to pass through, and by the limitation on pivoting because of cam following projections 36*a* and 36*b* contacting upper wall of channel 28, or by a combination of these elements. Thus, turning knob 20 imparts to and fro movement to actuator slide 26, which cams axles 30 into pivoting spikes 18 into and out of openings 22.

I claim:

1. A retractable spike shoe, comprising:

a sole having a toe end and a heel end, said sole extending longitudinally between said toe and heel ends, said sole having an undersurface, a closed channel disposed longitudinally above said undersurface, and a plurality of openings opening to the undersurface;

a plurality of recessed parts disposed within said sole;

a plurality of axles disposed transversely within said sole and rotatably secured to said sole by respective ones of said recessed parts;

a plurality of spikes attached to said axles to rotate with said axles, said spikes disposed on said axles to rotate into and out of respective openings in response to actuator means; and actuator means disposed in said closed channel for translating a transverse movement to a rotational movement of said spikes, said actuator means including, an elongate actuator slide recessed in said closed channel, said closed channel being longer than said actuator slide so that said actuator slide may move axially to and fro within said closed channel, cam following means fixedly attached to said axles, said actuator slide including camming means for camming said cam following means to rotate said axles, a knob extending from said sole, said knob being rotatable and said knob being operatively connected to said actuator slide to produce a to and fro movement of said actuator slide when said knob is manipulated, a first spring connected to the sole proximate the toe end, said first spring being also connected to said actuator slide to pull said actuator slide toward said toe end, whereby said knob is operatively connected to said actuator slide by pulling said slide when said knob is pulled thereby causing said first spring to be extended, and stop means for holding said first spring extended.

2. The retractable spike shoe of claim 1, wherein said stop means is a stop wall being disposed between said actuator slide and said heel end, said stop wall having a slotted opening having a length and a width across said opening, said length being greater than said width, wherein said actuator has flanges connected to said knob to turn with said knob when said knob is turned, said flanges extended in a transverse direction to said actuator slide and said flanges being able to pass through said slotted opening only when said flanges are aligned with the length of said slotted opening so that by turning said knob to turn said flanges out of alignment with the length of said slotted opening, said flanges press against said wall to stop movement of said actuator slide toward said toe end.

3. A retractable spike shoe, comprising:

a sole having a toe end and a heel end, said sole extending longitudinally between said toe and heel ends, said sole having an undersurface, a closed channel disposed longitudinally above said undersurface, and a plurality of openings opening to the under surface;

a plurality of recessed parts disposed within said sole;

a plurality of axles disposed transversely within said sole and rotatably secured to said sole by respective ones of said recessed parts;

a plurality of spikes attached to said axles and projecting outwardly therefrom to rotate with said axles into and out of respective ones of said openings in response to an actuator; and an actuator including an elongate actuator slide recessed in said closed channel, said closed channel being longer than said actuator slide so that said actuator slide may move axially to and fro within said closed channel, said actuator also including cam following means fixedly attached to said axles, said actuator slide including camming means for camming said cam following means to rotate said axles, said actuator further including a knob extending from said sole and a shaft fixedly attached to said knob, said shaft having a threaded end and said actuator slide having a threaded coupling receiving said threaded end so that said knob and said actuator slide are operatively connected by said threaded coupling receiving said threaded end of said shaft, said knob being rotatable to rotate said shaft in one rotary direction to cause said threaded end to screw into said threaded coupling and to rotate said shaft in an opposite rotary direction to cause said threaded end to screw out of said coupling, to produce a to and fro movement of said actuator slide.

4. A retractable spike shoe, comprising:

a sole having a toe end and a heel end, said sole extending longitudinally between said toe and heel ends, said sole having an under surface, a closed channel disposed longitudinally above said under surface, and a plurality of openings opening to the under surface;

a plurality of recessed parts disposed within said sole;

a plurality of axles disposed transversely within said sole and rotatably secured to said sole by respective ones of said recessed parts;

a plurality of spikes attached to said axles to rotate said axles, said spikes disposed on said axles to rotate into and out of respective ones of said openings in response to an actuator; and an actuator including an elongate actuator slide recessed in said closed channel, said closed channel being longer than said actuator slide so that said actuator slide may move axially to and fro within said closed channel, said actuator including cam following means fixedly attached to said axles, said actuator slide including camming means for camming said cam following means to rotate said axles, said actuator including a first spring connected to the sole proximate the toe end, said first spring being also connected to said actuator slide to pull said actuator slide toward said toe end, said actuator including a knob extending from said sole and being operatively connected to said actuator slide so that pulling said knob will cause said slide to be pulled, thereby causing said first spring to be extended, and said actuator having stop means for holding said first spring extended.

* * * * *